US007013948B1

(12) United States Patent
Grebe et al.

(10) Patent No.: US 7,013,948 B1
(45) Date of Patent: Mar. 21, 2006

(54) DISINTEGRATIVE CORE FOR USE IN DIE CASTING OF METALLIC COMPONENTS

(75) Inventors: David E. Grebe, Fond du Lac, WI (US); Mark P. Potratz, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/000,724

(22) Filed: Dec. 1, 2004

(51) Int. Cl.
*B22C 9/10* (2006.01)

(52) U.S. Cl. ..... 164/137; 164/302; 164/340; 164/365; 164/369

(58) Field of Classification Search ..... 164/365–369, 164/302, 340, 351, 28, 137
See application file for complete search history.

(56) References Cited

U.S. PATENT DOCUMENTS

| | | | | |
|---|---|---|---|---|
| 3,764,575 A | | 10/1973 | Anderko et al. | 260/37 R |
| 3,801,334 A | | 4/1974 | Dewey, Jr. | 106/38.3 |
| 3,963,818 A | | 6/1976 | Sakoda et al. | 264/56 |
| 3,964,534 A | | 6/1976 | Rabinowitz | 164/7 |
| 4,154,289 A | * | 5/1979 | Jeanneret | 164/358 |
| 4,361,181 A | | 11/1982 | Wischnack et al. | 164/522 |
| 4,446,906 A | | 5/1984 | Ackerman et al. | 164/112 |
| 4,467,858 A | * | 8/1984 | Trinkl et al. | 164/360 |
| 4,875,517 A | | 10/1989 | Donahue et al. | 164/34 |
| 5,165,464 A | | 11/1992 | Donahue et al. | 164/113 |
| 5,273,098 A | | 12/1993 | Hyndman et al. | 164/15 |
| 5,303,761 A | | 4/1994 | Flessner et al. | 164/15 |
| 5,632,326 A | | 5/1997 | Gough | 164/529 |
| 5,803,151 A | | 9/1998 | Carden | 164/5 |
| 6,458,297 B1 | | 10/2002 | Moschini | 264/12 |
| 6,755,238 B1 | | 6/2004 | Hirokawa | 164/529 |

* cited by examiner

*Primary Examiner*—Kuang Y. Lin
(74) *Attorney, Agent, or Firm*—William D. Lanyi

(57) ABSTRACT

A disintegrative member, such as a salt core, is provided with a vent opening extending through its thickness from an outer surface to an inner surface in order to allow gases to pass radially inwardly through the body of the salt core and away from a region proximate the salt core's outer surface. The escape of these gases through the vent opening decreases the likelihood that porosity will be formed as a result of those gases being trapped in a region proximate the outer surface of the salt core because the molten metal solidifies more slowly in this area because of the thermal insulative qualities of the disintegrative member.

18 Claims, 6 Drawing Sheets

DISINTEGRATIVE CORE FOR USE IN DIE CASTING OF METALLIC COMPONENTS

BACKGROUND OF THE INVENTION

1. Field of the Invention

The present invention is generally related to a disintegrative core for use in die casting and, more particularly, to a particular structure of a salt core which reduces porosity in a cast metallic object in the vicinity of a cavity formed around the disintegrative core.

2. Description of the Prior Art

Those skilled in the art of die casting are familiar with the use of disintegrative cores, such as salt cores, that are used to define the shape of a cavity within a cast metallic component.

U.S. Pat. No. 3,764,575, which issued to Anderko et al. on Oct. 9, 1973, describes a salt core containing synthetic resin and water-glass as binders. In the manufacture of a casting having a cavity, wherein a water soluble salt core is suspended in a mold, molten material is poured into the mold about the core, the molten material is allowed to harden to the desired casting, and the core is washed away with water to leave a hollow casting.

U.S. Pat. No. 3,801,334, which issued to Dewey on Apr. 2, 1974, describes salt casting mixtures. Alkaline metal nitrates and nitrates are useful as core material for making disposable cores, mandrels and other forms for use in making hollow plastic articles.

U.S. Pat. No. 3,963,818, which issued to Sakoda et al. on Jun. 15, 1976, describes a water soluble core for pressure die casting and process for making the same. The process includes pre-drying a granular water soluble salt having grain size of less than about 1,000 microns so that the moisture content thereof becomes less than 1%, molding under compression the granular water soluble salt into a desired shape and volume at a pressure of between 1.5 to 4 tons per square centimeter, and if necessary, sintering the molded salt at a temperature of between about 100 degrees to 300 degrees centigrade.

U.S. Pat. No. 3,964,534, which issued to Rabinowitz on Jun. 22, 1976, describes a casting method with a vacuum bonded dry sand core. A method for preparing sand cored parts is disclosed which is applicable to certain types of molding techniques where the mold cavity is at least slightly porous, such as a shell molding, green sand molding, and most importantly, the cavityless method of molding.

U.S. Pat. No. 4,361,181, which issued to Wischnack et al. on Nov. 30, 1982, describes a casting core and process for the production thereof. A casting core is intended for the creation of difficultly accessible cavities in castings of aluminum or of one of its alloys, produced from a water soluble salt as base substance and burnt sugar as a binding agent, and a process for the production of such a casting core wherein the base substance is mixed with burnt sugar in aqueous or organic solution, pressed in molds, and baked at elevated temperature.

U.S. Pat. No. 4,446,906, which issued to Ackerman et al. on May 8, 1984, describes a method of making a cast aluminum based engine block. A method of making a die cast aluminum based engine block with a closed deck is disclosed. A core assembly having at least one water soluble alkaline metal salt core member is stationed on a bore die of a die casting assembly for the block.

U.S. Pat. No. 4,875,517, which issued to Donahue et al. on Oct. 24, 1989, discloses a method of producing salt cores for use in die casting. A pattern, identically proportional in configuration to the salt core to be produced, is initially formed from an evaporable foam material. The evaporable foam pattern is positioned in a mold and surrounded with an unbonded flowable material, such as sand. The pattern is contacted with a molten salt and the high temperature of the salt will vaporize the pattern, with the vapor being captured within the interstices of the sand while the molten salt will fill the void created by vaporization of the foam to provide a salt core identical in configuration to the pattern.

U.S. Pat. No. 5,165,464, which issued to Donahue et al. on Nov. 24, 1992, discloses a method of casting hypereutectic aluminum-silicon alloys using a salt core. A method of high pressure casting of hypereutectic aluminum-silicon alloys using a salt core to form wear resistant articles, such as engine blocks, is described. To produce an engine block, one or more solid salt cores are positioned within a metal mold with the space between the cores and the mold defining a die cavity.

U.S. Pat. No. 5,273,098, which issued to Hyndman et al. on Dec. 28, 1993, describes removable cores for metal castings. A method for the manufacture of salt cores is described.

U.S. Pat. No. 5,303,761, which issued to Flessner et al. on Apr. 19, 1994, describes a die casting using casting salt cores. A process of providing a disposable core for use in die casting processes is described. A salt material is molten and cast into a core of a desired configuration under exacting conditions. The fluidity of the molten salt is controlled enabling casting the salt material into a core by die casting methods.

U.S. Pat. No. 5,632,326, which issued to Gough on May 27, 1997, describes a mold and method for the casting of metals and refractory compositions for use therein. A mold for metal casting contains a bonded refractory composition comprising hollow alumina-containing microspheres in which the alumina content is at least 40% by weight.

U.S. Pat. No. 5,803,151, which issued to Carden on Sep. 8, 1998, describes a soluble core method of manufacturing metal cast products. An improved soluble core for die casting metals or metal matrix compositions is formed of a mixture of salt and up to 20% weight of ceramic material blended together to produce a homogenous mixture and compacted under pressure to produce a soluble core having little or no porosity.

U.S. Pat. No. 6,458,297, which issued to Moschini on Oct. 1, 2002, describes a method for producing pressure die cast or injection molded articles using salt cores. A method for producing pressure die cast or injection molded articles having a unit for producing salt grains, a press for forming salt filler cores by compressing the salt grains, a pressure die casting machine for making the said articles by injecting a material in the liquid state into a mold having at least one salt filler core, and a salt removal and washing unit designed to remove the salt filler cores that have been trapped within the articles is described.

U.S. Pat. No. 6,755,238, which issued to Hirokawa on Jun. 29, 2004, describes a disintegrative core for high pressure casting. It discloses a method for manufacturing a disintegrative core for use in high pressure casting. The disintegrative core can be applied where a light metal such as an aluminum alloy or magnesium alloy is subjected to high pressure casting, such as die casting or squeeze casting and is manufactured from a water soluble salt which is high in latent heat and ranges, in melting point, from 280 to 520 degrees centigrade. The salt, alone or in combination with a fine hard powder, is melted and solidified in a core mold. Alternatively, the melt is produced into a fine powder which is then molded into a core mold. The method can be applied for the manufacture of complex shapes of cores.

The patents described above are hereby expressly incorporated by reference in the description of the present invention.

SUMMARY OF THE INVENTION

A method for producing a cast metallic object having a cavity formed therein, in accordance with a preferred embodiment of the present invention, comprises the steps of providing a disintegrative member having an outer surface portion which is shaped to conform with a desired shape of the cavity. The disintegrative member has an internal surface. The method further comprises the step of providing a vent opening extending between the outer surface of the disintegrative member and the inner surface.

A preferred embodiment of the present invention further comprises the step of providing an internal opening within the disintegrative member which is shaped to receive an extension of a die used in a die casting operation. The internal surface can be a surface of the internal opening within the disintegrative member which is shaped to receive the extension of the die.

In a preferred embodiment of the present invention, the extension is a mandrel and the internal opening has a hexagonal cross section. The disintegrative member is made of salt and the cast metallic object is an engine block. The cavity is a cylinder in the engine block. The outer surface portion of the disintegrative member is generally cylindrical and the vent opening is a hole extending through the outer surface portion and through the internal surface of the disintegrative member.

In a particularly preferred embodiment of the present invention, the method further comprises the steps of attaching the disintegrative member to a die which is shaped to define the cast metallic object, injecting molten metal, such as aluminum, into the die and around the disintegrative member, and dissolving the disintegrative member after the molten metal solidifies to form the cast metallic object and the cast metallic object is removed from the die.

The disintegrative member, in a preferred embodiment of the present invention, has an outer surface portion which is shaped to conform with the desired shape of the cavity. It also has the internal surface and a vent opening, or hole, extending between the outer surface and the internal surface.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 2:
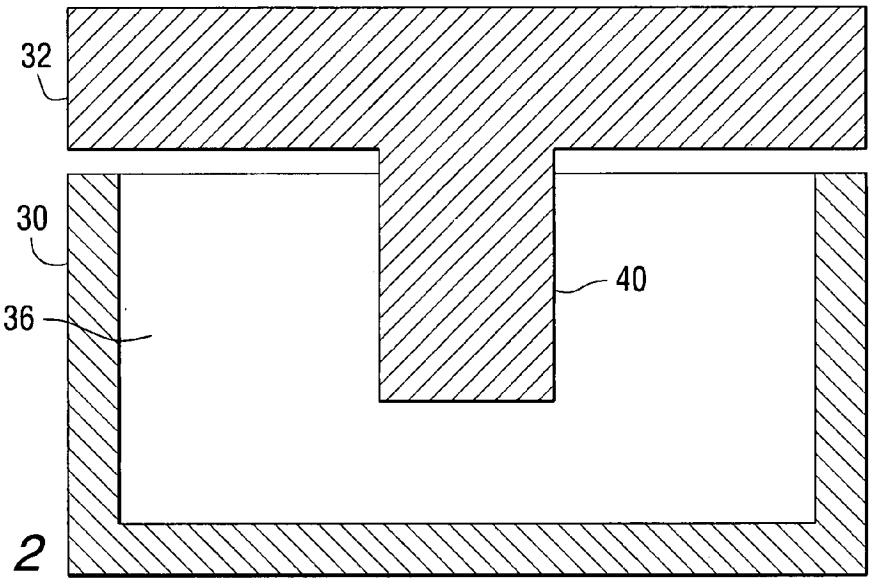
FIGS. 2 and 3 are two views of a die used to form a cast metallic object.

Throughout the description of the preferred embodiment of the present invention, like components will be identified by like reference numerals.

Figure 1:
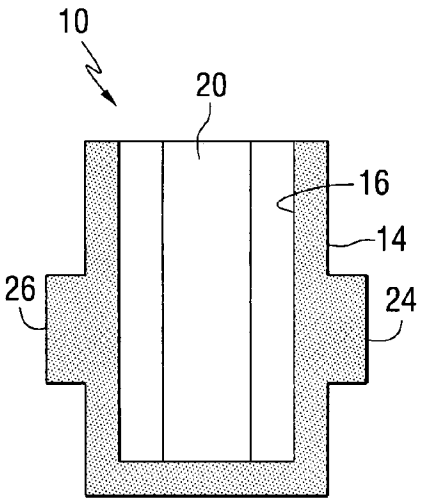
FIG. 1 is a simplified representation of a disintegrative member used to form cavities in cast metallic objects.

FIG. 1 is a simplified schematic representation of an exemplary disintegrative member 10. In a typical application of the present invention, the disintegrative member 10 is a salt core. The disintegrative member 10 is shaped to conform with a desired shape of a cavity which is intended to be formed in a cast metallic object. The disintegrative member 10 has an internal surface 16. As will be described below, the internal surface 16 in one embodiment of the present invention is a surface of an internal opening 20 that is formed within the disintegrative member 10 and shaped to receive an extension of a die, such as a mandrel of a die casting mold.

With continued reference to FIG. 1, the internal opening 20 can be shaped to have a hexagonal cross section, the disintegrative member 10 can be made of salt, and the cast metallic object can be an engine block with the cavity being a cylinder in the engine block.

With continued reference to FIG. 1, the exemplary disintegrative member 10 is shown with two protrusions, 24 and 26, extending from its outer surface portion 14. These protrusions are intended to form openings in the wall of the cavity, such as air intake passages through the wall of a cylinder within an engine block.

Figure 3:
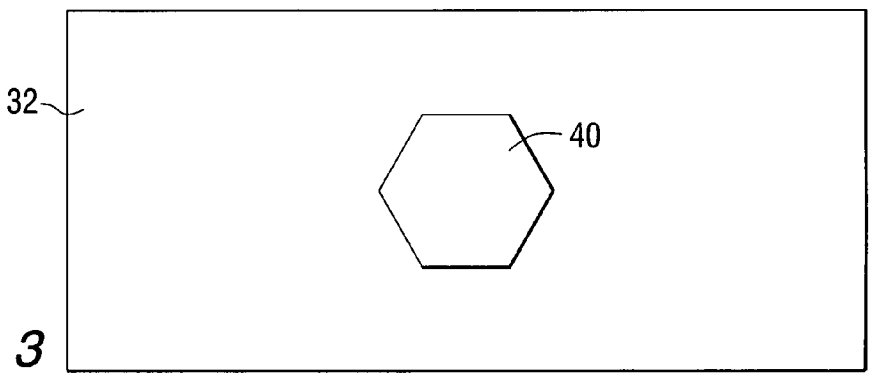

FIG. 2 is a highly simplified exemplary representation of two portions, 30 and 32, of a die which are usable in a die casting machine. The internal cavity 36 of the die is shaped to define the desired surfaces of the cast metallic object. One portion 32 of the die is provided with a mandrel 40 that is shaped to hold a disintegrative member in place during the die casting operation. FIG. 3 shows a bottom view of the second portion 32 of the die which illustrates the hexagonal shape of the mandrel 40, or extension.

Figure 4:
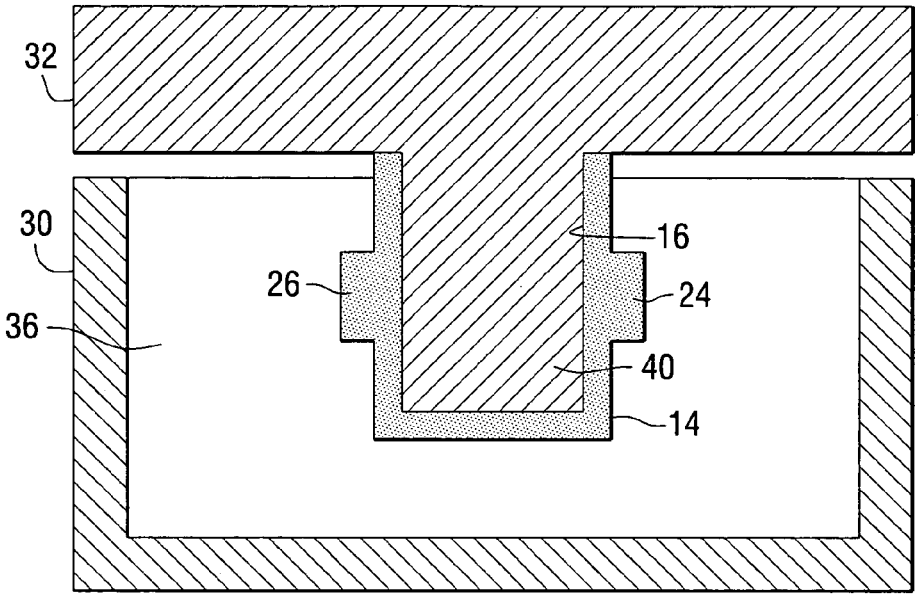
FIG. 4 shows the die of FIG. 2 with a salt core attached thereto.

FIG. 4 shows the disintegrative member 10 associated with the mandrel 40, or extension, of the second portion 32 of the die. The internal opening 20 of the disintegrative member 10, discussed above in conjunction with FIG. 1, is shaped to receive the mandrel 40 within it and retain the disintegrative member 10 in place prior to and during the injection of molten metal into the cavity 36 of the die. The presence of the disintegrative member 10 within the cavity 16 of the die allows a cavity to be formed within the cast metallic object. After the cast metallic object is removed from the die, the disintegrative member 10 can be disintegrated, or dissolved, to remove it from the cast metallic object, leaving a precisely shaped cavity within the metallic object. Those skilled in the art of die casting are familiar with the use of disintegrative members and are also familiar with the many different applications in which these disintegrative members 10 can be used. Cylinders of an engine block are only one of numerous examples where salt cores are shaped to define internal cavities within the cast metallic object and are then later dissolved and removed from the cast metallic object, leaving precisely shaped and dimensioned cavities in the cast metallic object.

Figure 5:
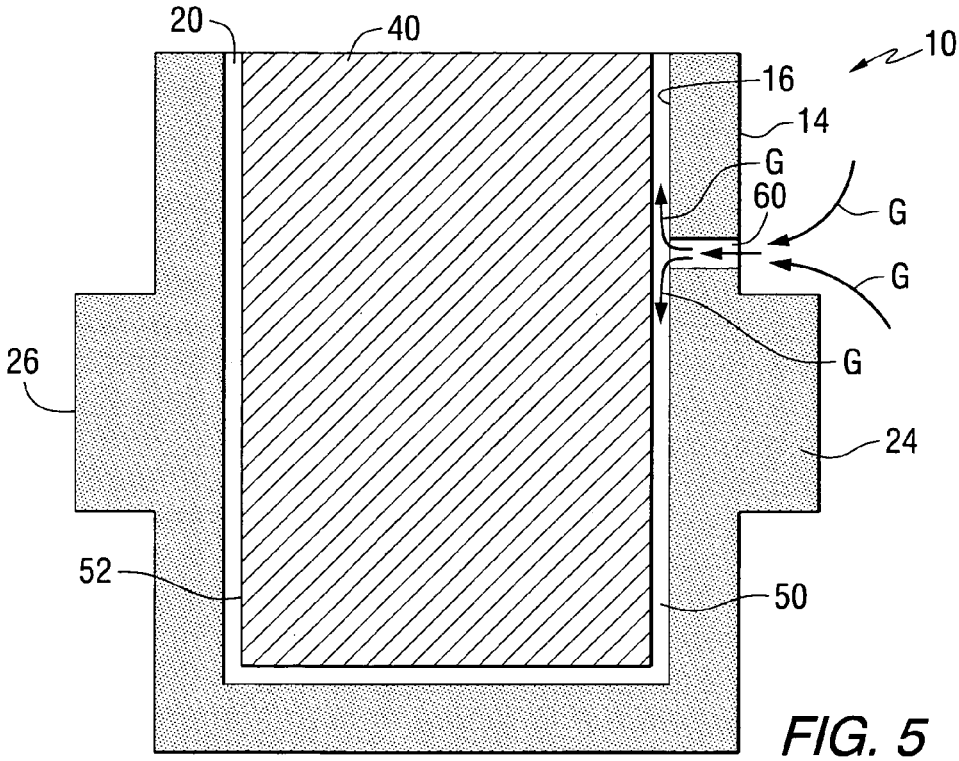
FIG. 5 is a simplified representation of a disintegrative member with a vent opening of the present invention.

FIG. 5 is an enlarged representation of the disintegrative member 10 and the portion of the mandrel 40 which is disposed within the internal opening 20 of the disintegrative member 10. For purposes of illustration, the space 50 surrounding the mandrel 40 within the internal opening 20 is shown in an enlarged representation in FIG. 5. In reality, the internal opening 20 is shaped to provide a sliding fit between the internal surface 16 of the internal opening 20 and the outer surface 52 of the mandrel. That space 50 is exaggerated in FIG. 5 for purposes of facilitating a description of the beneficial operation resulting from the present invention.

With continued reference to FIG. 5, a vent opening 60 is illustrated through a portion of the wall of the disintegrative member 10 between the outer surface portion 14 and the internal surface 16 of the internal opening 20. As a result, when molten metal surges against the outer surface of the disintegrative member 10, the vent opening 60 provides a path through which gases can flow and move away from the material of the cast metallic object. It prevents entrapment of those gases in the metallic object. The flow of these gases, and some molten metal, is represented by the arrows G in FIG. 5.

In order to fully understand the benefit provided by the present invention, it is necessary to understand one of the problems that can be encountered in die casting processes, particularly in die casting processes which use disintegrative members. It has been observed that porosity within the structure of the cast metallic object can occur in certain regions, particularly those regions proximate the outer surface of the disintegrative member, during the die casting process. Metallographic analysis has shown that the porosity, which is typically exposed by subsequent machining of the cavity, is different from normal porosity that typically affects engine block integrity. The porosity experienced in the vicinity of the disintegrative member is a layered porosity and is associated with the hot metal immediately proximate to the disintegrative member, such as the salt core. This hot metal is inhibited from cooling in a normal manner because the salt core is an efficient insulator. As a result, the disintegrative member, or salt core, does not allow the same type of heat transfer through its structure that occurs through the metallic structure of the die. As a result, engine blocks or other large structures, that are made with large salt cores, experience a disadvantageous situation because the large disintegrative members change the temperature gradient profile through the cast metallic object during the solidification of the molten metal. As a result, a plane of porosity occurs at the interface between the solidification front of the molten metal and the outer surface of the disintegrative member. Rapid heat extraction through the metal dies and the delayed solidification front near the salt core surface contribute to this problem. The interface next to the outer surface of the disintegrative member forms adjacent to the salt core and is generally exposed at a later time during the machining of the cylinder bore or cavity formed by the salt core. Trapped cavity gases normally do not have a path for escaping from the molten metal as it solidifies. These cavity gases reside at the interface near the outer surface of the salt core. Examination of these cast metallic objects suggest that a thermal gradient phenomena results during the solidification event and the evidence indicates that certain portions of the molten metal remain in "hot spots" and cool at a slower rate because of the insulating characteristic of the disintegrative member, such as the salt core.

The intent of the present invention is to provide a way to allow these gases to escape from these "hot spots" that result from the low thermal conductivity of the material used to make the disintegrative cores. Since a small amount of space 50 is available between the internal surface 16 of the internal opening 20 and the outer surface 52 of the mandrel 40, a hole, such as the vent opening 60, formed in a location such as that represented in FIG. 5 can allow gases G to escape from the molten and solidifying metal to the space 50. It is also likely that a quantity of molten metal will pass from the region proximate the outer surface portion 14 and flow through the vent opening 60 into the space 50 proximate the internal surface 16. However, that small amount of metal can be removed by machining after the salt core 10 is removed from the solidified cast metal object.

With continued reference to FIGS. 1–5, it should be understood that the disintegrative member 10 need not have a large number of vent openings 60 formed through its wall structure. Instead, the number and location of the vent openings 60 can be limited to those areas that have previously been identified as being regions where porosity has formed or is likely to form as a result of the overall conditions of the die cavity, the quantities of molten metal used to form the cast metallic object, and the geometries associated with the disintegrative members 10. After a region of porosity is identified, a hole 60 can be formed in that specific region to allow the escape of gases through the vent opening 60 and into the space 50 within the internal opening 20.

It should be understood that FIGS. 1–5 are simplified representations which are illustrated in a basic manner for the purpose of describing the underlying philosophy of the present invention. In the figures that will be described below, a particularly preferred embodiment of the present invention will be disclosed in relation to an engine block of a V-6 engine that is die cast with the use of six disintegrative members that define the shape and size of six cylinders of the engine.

Figure 6:
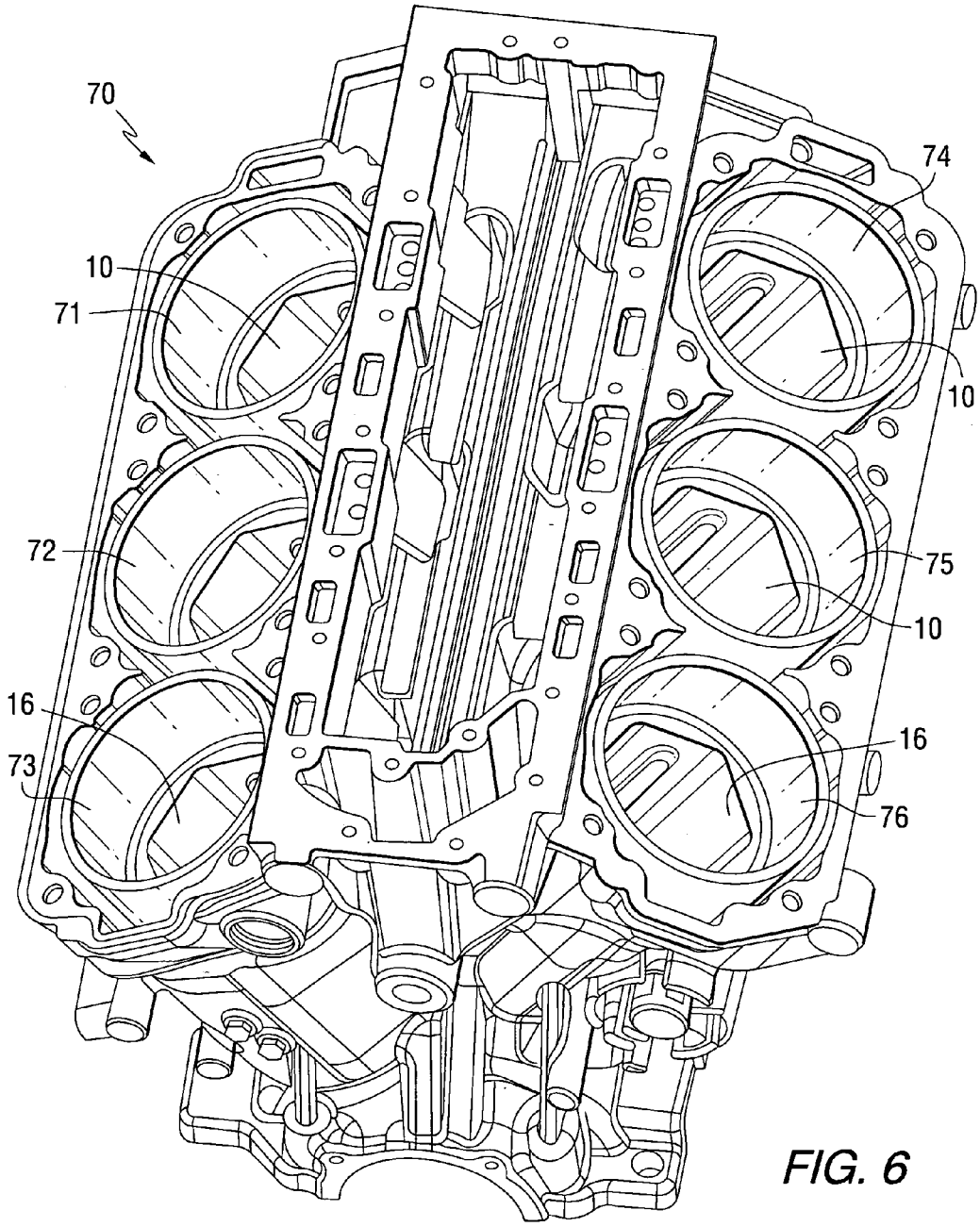
FIG. 6 is an isometric view of an engine block with salt cores disposed within its cylinder openings.

FIG. 6 is an isometric view of a V-6 engine 70 in which the cylinder bores are made through the use of the disintegrative members 10. The cylinder bores, 71–76, are each shown in FIG. 6 with the disintegrative member 10 remaining in place subsequent to the die casting operation through which the engine 70 was formed. As is known to those skilled in the art, the disintegrative members 10 are subsequently dissolved, through the use of water, and the shape of the disintegrative member 10 and its various protrusions result in the shape of the cylinder 71–76 and its various intake ports and exhaust ports. The internal surface 16 is identified in conjunction with cylinders bores 73 and 76 in FIG. 6. In the embodiment of the disintegrative member 10 shown in FIG. 6, the internal surface 16 is generally hexagonal and is shaped to receive the mandrel 40 which is described above in conjunction with FIGS. 2, 3, 4, and 5. The other portions of the engine 70 illustrated in FIG. 6 are not directly related to the use of the disintegrative member 10 and will not be described in detail herein.

Figure 7:
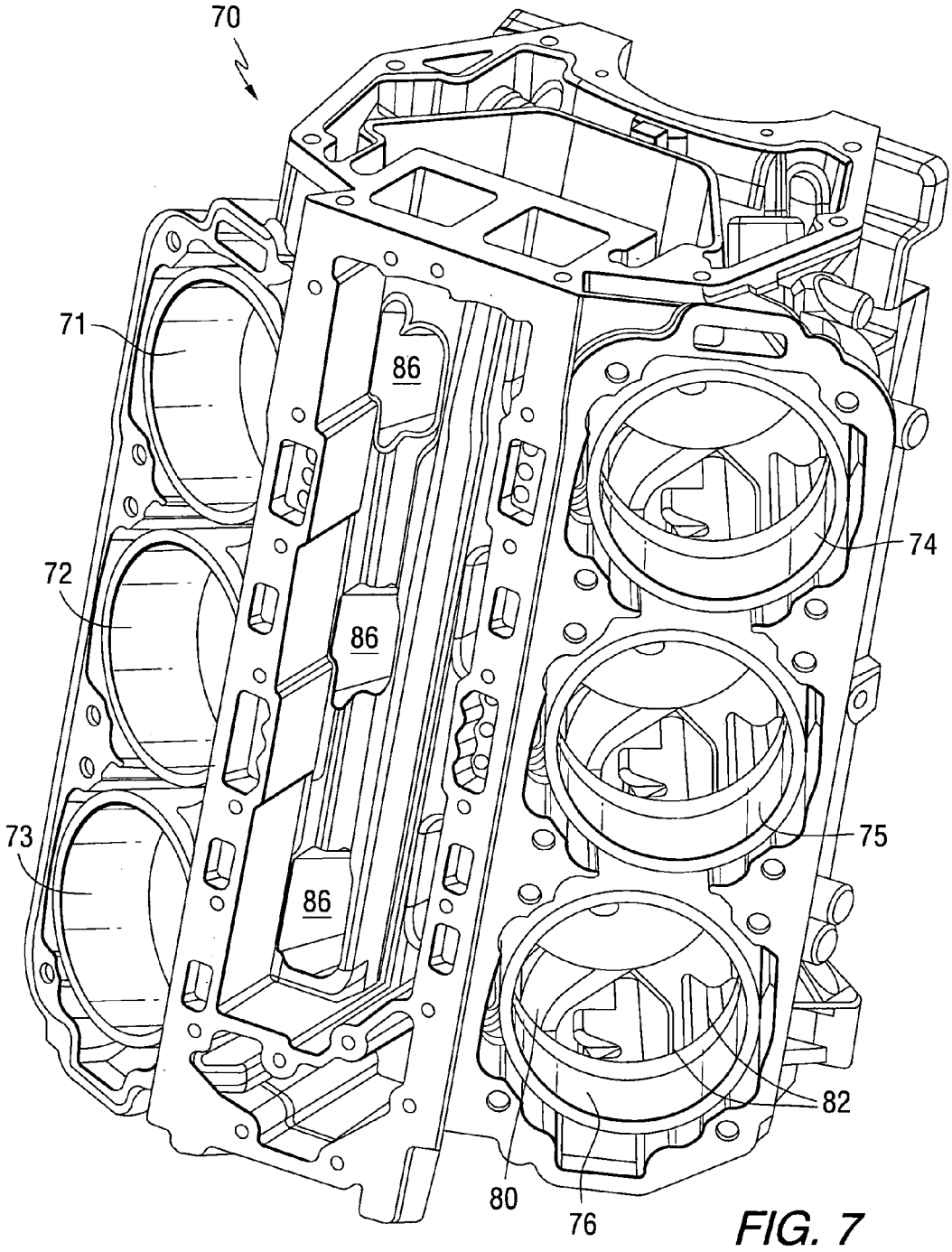
FIG. 7 is similar to FIG. 6, but with the salt cores removed from the cylinder bores.

FIG. 7 shows the engine 70 after the disintegrative members have been removed by dissolving them with water. Each of the cylinder bores is provided with several intake ports and an exhaust port. With reference to cylinder bore 76 in FIG. 7, an intake port 80 is visible along with intake ports 82. It should be understood that in the particular engine block shown in FIG. 7, other intake ports are also provided in each cylinder, but are not readily visible in FIG. 7. In addition, each cylinder is provided with an exhaust port 86. The exhaust ports 86 of cylinders 71–73 are visible in FIG. 7 where they extend into the exhaust manifold which is located centrally between the two banks of cylinders.

Figure 8:
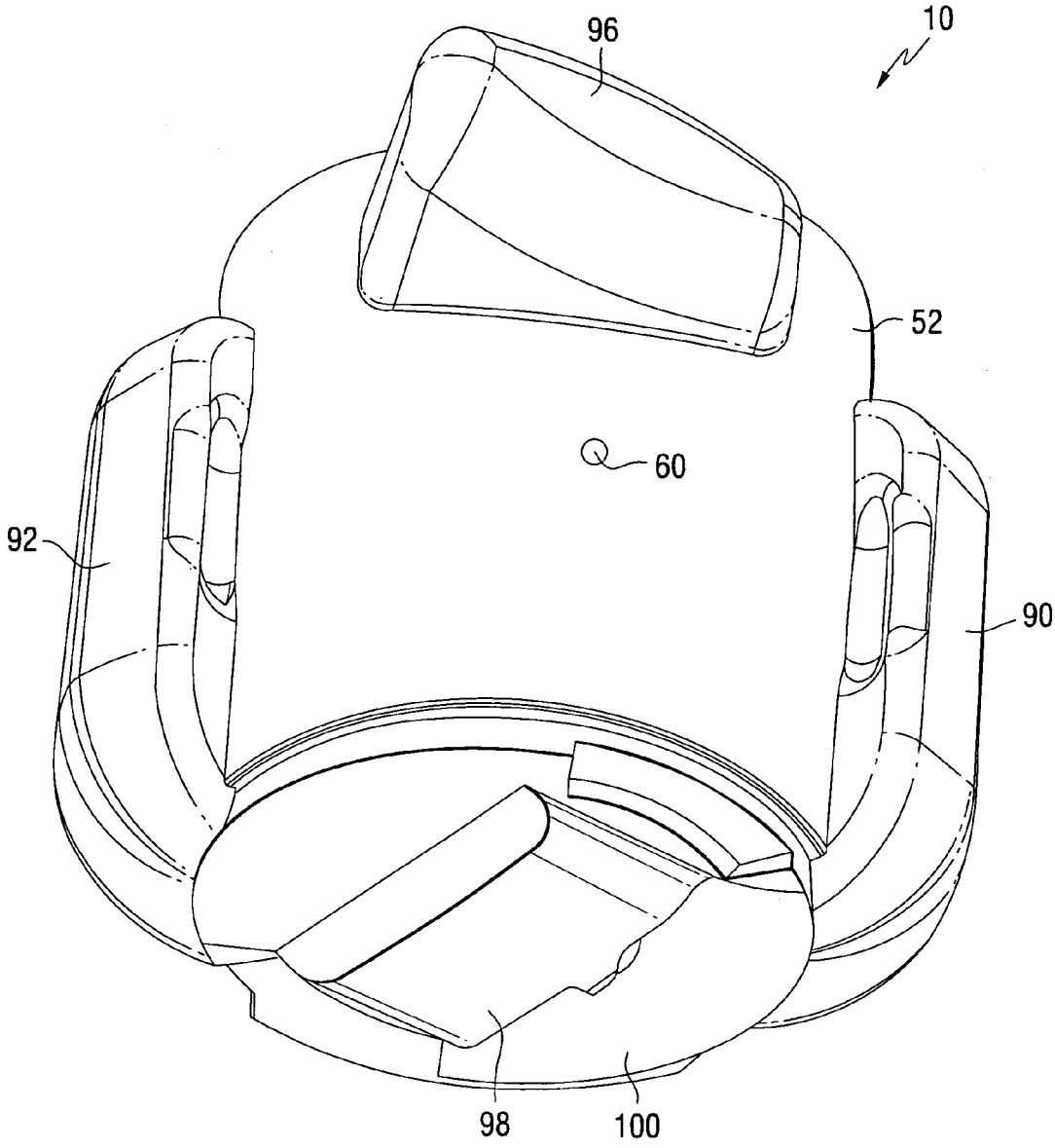
FIG. 8 is an isometric view of a salt core made in accordance with a preferred embodiment of the present invention.

FIG. 8 is an isometric view of a disintegrative member 10 made in accordance with a preferred embodiment of the present invention. The disintegrative member 10 has an outer surface portion 52 which, as described above, is shaped to conform with the desired shape of the cavity to be shaped in the cast metal object. In other words, the outer surface portion 52 is generally cylindrical and shaped to form the cylindrical portion of a cylinder, such as one of the cylinders 71–76 described above in conjunction with FIGS. 6 and 7. Several protrusions are shown extending radially outwardly from the outer surface portion 52. For example, the protrusions identified by reference numerals 90 and 92 are shaped to result in the formation of intake openings through the wall of the cylinder of the cast metallic object, such as the engine 70 described above in conjunction with FIG. 7. It should be noted that the protrusions 90 and 92 are generally analogous to the exemplary protrusions 24 and 26 described above in conjunction with FIGS. 1 and 5. Another protrusion 96 extends from the outer surface portion 52 of the disintegrative member 10 and is shaped to result in the formation of an exhaust cavity 86 which was described above in conjunction with FIG. 7. At the end of the disintegration member 10, a protrusion 98 is shaped to result in an opening through which a connecting rod extends for connection between a piston and a crankshaft of the engine. The vent opening 60 is illustrated at a location which is below the protrusion 96 for the exhaust port and between that protrusion and the closed end 100 of the disintegrative member 10. As described above in conjunction with FIG. 5, the purpose of the vent opening 60 is to allow gases to pass radially inwardly toward the internal surface 16 of the disintegrative member 10, such as a salt core, in order to vent those gases away from the region proximate the outer surface portion 52 of the disintegrative member 10.

With continued reference to FIG. 8, one particular embodiment of the present invention utilizes a single vent opening 60 for these purposes. However, it should be understood that other applications of the present invention could use a plurality of vent openings 60 to prevent porosity at other locations close to the outer surface portion 52 of the disintegrative member 10. In a possible application of the present invention, regions of porosity can be identified after occurrence and detection and, subsequently, the salt core can be provided with a vent opening 60 in the particular region identified as being a problem area with regard to the formation of porosity that results because of the insulative characteristics of the disintegrative member 10.

Figure 9:
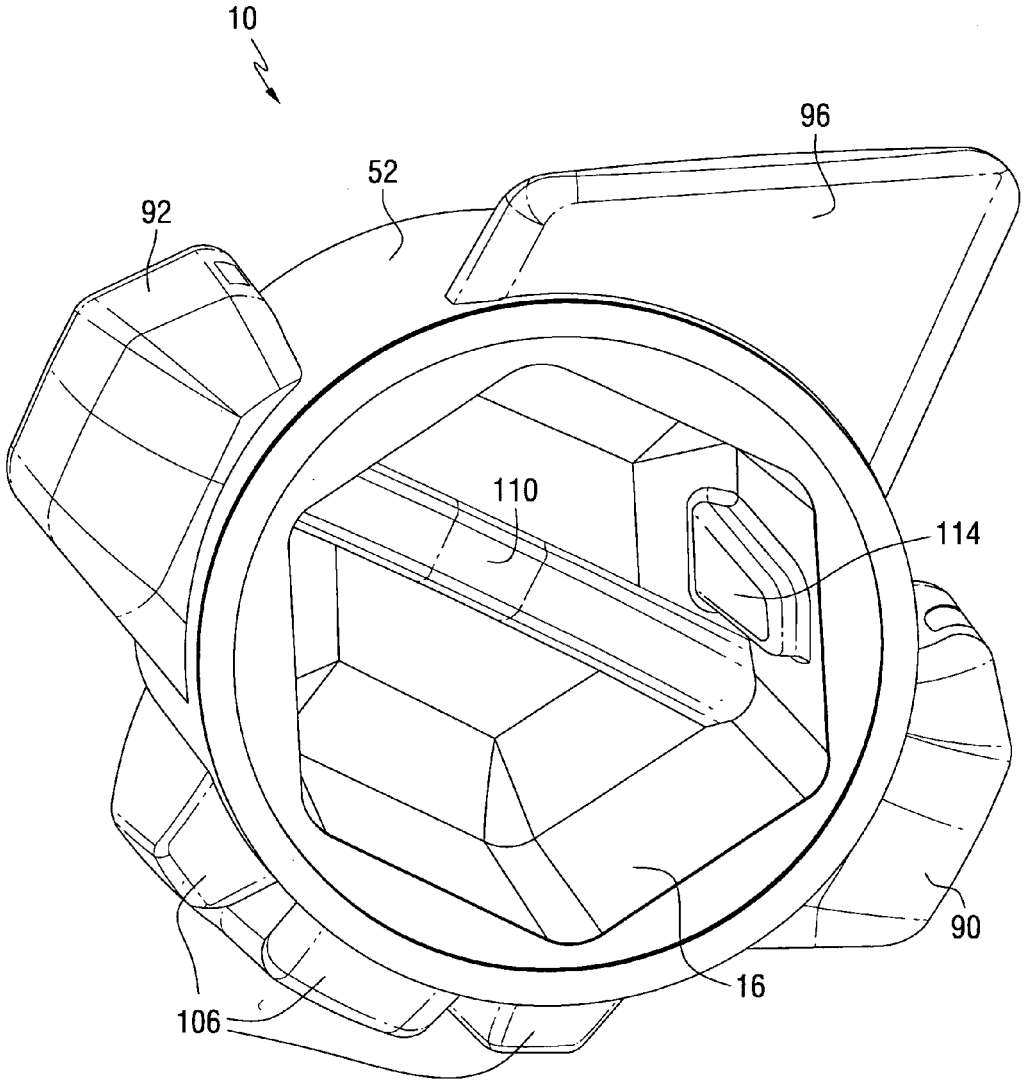
FIG. 9 is an alternative view of the core illustrated in FIG. 8.

FIG. 9 is an isometric view of the disintegrative member 10 showing the open end of the salt core. The internal surface 16, which is generally hexagonal in cross section, is shown along with a bottom rib 110 formed in the bottom of the internal opening of the disintegrative member 10. An alignment protrusion 114 is formed in one surface of the hexagonally shaped opening and is used as an indexing aid to make sure that the disintegrative member 10 is properly aligned in association with the mandrel 40 which is shaped to be received within the opening and in close proximity to the internal surfaces 16. The vent opening 60 is not visible in FIG. 9, but is located behind the protrusion 96 that forms the exhaust port in the cast metallic object. In addition to the protrusions, 90 and 92, which form the intake ports of the cylinders, protrusions 106 are provided to form intake ports.

With reference to FIGS. 1–9, it can be seen that the method for producing a cast metallic object having a cavity formed therein, in accordance with a preferred embodiment of the present invention, comprises the steps of providing a disintegrative member 10 having an outer surface portion 52 which is shaped to conform with a desired shape of the cavity, such as a cylinder 71–76. The disintegrative member 10 has an internal surface 16. The method of the present invention further provides a vent opening 60 extending between the outer surface 52 and the internal surface 16. An internal opening 20 is provided within the disintegrative member 10 and this opening 20 is shaped to receive an extension of a die, such as a mandrel 40. The internal opening 20 has a generally hexagonal cross section in a preferred embodiment of the present invention and the disintegrative member 10 is made of salt which is dissolvable through the use of water after the cast metallic object solidifies. The cast metallic object can be an engine block 70 and the cavity formed by the disintegrative member 10 can be a cylinder of the engine block. The outer surface portion 52 of the disintegrative member 10 is generally cylindrical and the vent opening 60 can be a hole extending through the outer surface portion 52 and through the internal surface 16. By providing the vent opening 60, gases are allowed to escape inwardly into the central opening 20 of the disintegrative member 10 and porosity in the region proximate the outer surface portion 52 can avoided.

Although the present invention has been described with considerable specificity and illustrated to show a particularly preferred embodiment in conjunction with an engine block, it should be understood that alternative embodiments are also within its scope.

We claim:

1. A method for producing a cast metallic object having a cavity formed therein, comprising the steps of:

providing a disintegrative member having an outer surface portion which is shaped to conform with a desired shape of said cavity, said disintegrative member having an internal surface;

providing a vent opening extending between said outer surface portion and said internal surface;

providing a die having an extension;

providing an internal opening within said disintegrative member which is shaped to receive said extension of said die;

attaching said disintegrative member to said die by inserting said extension of said die into said internal opening within said disintegrative member.

2. The method of claim 1, wherein:

said internal surface is a surface of said internal opening within said disintegrative member which is shaped to receive said extension of said die.

3. The method of claim 1, wherein:

said extension is a mandrel.

4. The method of claim 1, wherein:

said internal opening has a hexagonal cross section.

5. The method of claim 1, wherein:

said disintegrative member is made of salt.

6. The method of claim 1, wherein:

said cast metallic object is an engine block.

7. The method of claim 6, wherein:

said cavity is a cylinder in said engine block.

8. The method of claim 1, wherein:

said outer surface portion of said disintegrative member is generally cylindrical.

9. The method of claim 1, wherein:

said vent opening is a hole extending through said outer surface portion and through said internal surface.

10. The method of claim 1, further comprising:

attaching said disintegrative member to said die which is shaped to define said cast metallic object;

injecting molten metal into said die and around said disintegrative member; and dissolving said disintegrative member after said molten metal solidifies to form said cast metallic object and said cast metallic object is removed from said die.

11. An apparatus for producing a cast metallic object having a cavity formed therein, comprising:

a disintegrative member having an outer surface portion which is shaped to conform with a desired shape of said cavity, said disintegrative member having an internal surface;

a vent opening extending between said outer surface portion and said internal surface;

a die having an extension;

an internal opening within said disintegrative member which is shaped to receive said extension of said die;

said disintegrative member being attached to said die at said extension of said die extending into said internal opening within said disintegrative member.

12. The apparatus of claim 11, wherein:

said internal surface is a surface of said internal opening within said disintegrative member which is shaped to receive said extension of said die;

said die receives molten metal therein around said disintegrative member for forming said cast metallic object upon solidification of said molten metal, said vent opening having solidified molten metal therein.

13. The apparatus of claim 12, wherein:

said extension is a mandrel.

14. The apparatus of claim 11, wherein:

said disintegrative member is made of salt.

15. The apparatus of claim 11, wherein:

said cast metallic object is an engine block.

16. The apparatus of claim 15, wherein:

said cavity is a cylinder in said engine block.

17. The apparatus of claim 11, wherein:

said outer surface portion of said disintegrative member is generally cylindrical.

18. The apparatus of claim 17, wherein:

said vent opening is a hole extending through said outer surface portion and through said internal surface.

* * * * *